US008967961B2

(12) United States Patent
McCaffrey

(10) Patent No.: US 8,967,961 B2
(45) Date of Patent: Mar. 3, 2015

(54) CERAMIC MATRIX COMPOSITE AIRFOIL STRUCTURE WITH TRAILING EDGE SUPPORT FOR A GAS TURBINE ENGINE

(75) Inventor: Michael G. McCaffrey, Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 630 days.

(21) Appl. No.: 13/309,514

(22) Filed: Dec. 1, 2011

(65) Prior Publication Data

US 2013/0142660 A1 Jun. 6, 2013

(51) Int. Cl.
*F01D 5/14* (2006.01)

(52) U.S. Cl.
USPC ..... 415/200; 416/229 A; 416/241 B

(58) Field of Classification Search
CPC ..... F01D 5/18; F01D 5/147; F01D 5/284; F05D 2300/603; F05D 2240/122
USPC ..... 415/200; 416/229 A, 229 R, 241 B; 29/889.71
See application file for complete search history.

(56) References Cited

U.S. PATENT DOCUMENTS

| | | | | |
|---|---|---|---|---|
| 7,066,717 | B2 | 6/2006 | Morrison et al. | |
| 7,255,535 | B2 * | 8/2007 | Albrecht et al. | 416/97 R |
| 7,278,830 | B2 | 10/2007 | Vetters | |
| 7,600,979 | B2 | 10/2009 | Steibel et al. | |
| 7,640,661 | B2 | 1/2010 | Despreaux et al. | |
| 2009/0185911 | A1 * | 7/2009 | Roberge | 416/236 R |
| 2011/0027065 | A1 * | 2/2011 | Bryan | 415/1 |
| 2011/0123322 | A1 * | 5/2011 | Allen-Bradley et al. | 415/191 |
| 2012/0301317 | A1 * | 11/2012 | Alvanos et al. | 416/241 B |

* cited by examiner

*Primary Examiner* — Liam McDowell
(74) *Attorney, Agent, or Firm* — Carlson, Gaskey & Olds, P.C.

(57) ABSTRACT

An airfoil for a gas turbine engine includes an aft trailing edge support between a pressure side and a suction side.

21 Claims, 8 Drawing Sheets

CERAMIC MATRIX COMPOSITE AIRFOIL STRUCTURE WITH TRAILING EDGE SUPPORT FOR A GAS TURBINE ENGINE

BACKGROUND

The present disclosure relates to a gas turbine engine, and more particularly to Ceramic Matrix Composite (CMC) components therefor.

The turbine section of a gas turbine engine includes a multiple of airfoils which operate at elevated temperatures in a strenuous, oxidizing type of gas flow environment and are typically manufactured of high temperature superalloys. CMC materials provide higher temperature capability than metal alloys and a high strength to weight ratio. CMC materials, however, may require particular manufacturing approaches as the fiber orientation primarily determines the strength capability.

CMC airfoil designs have struggled to create a thin trailing edge which is strong enough to avoid splitting due to thermal-mechanical loads. A natural geometric stress concentration occurs where the pressure and suction side airfoil walls come together into a sharp trailing edge feature. The stress concentration may be difficult to overcome with 2D, 2.5D and 3D fiber architectures.

SUMMARY

An airfoil for a gas turbine engine according to an exemplary aspect of the present disclosure includes a pressure side formed of at least one Ceramic Matrix Composite ply, a suction side formed of at least one Ceramic Matrix Composite ply and an aft trailing edge support between the pressure side and the suction side.

An airfoil for a gas turbine engine according to an exemplary aspect of the present disclosure includes a pressure side formed of at least one Ceramic Matrix Composite ply, a suction side formed of at least one Ceramic Matrix Composite ply and an aft trailing edge support between the pressure side and the suction side and a forward trailing edge support between said pressure side and said suction side.

A method of assembling a Ceramic Matrix Composite airfoil for a gas turbine engine according to an exemplary aspect of the present disclosure including venting an airfoil aft of an aft trailing edge support between a pressure side and a suction side.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
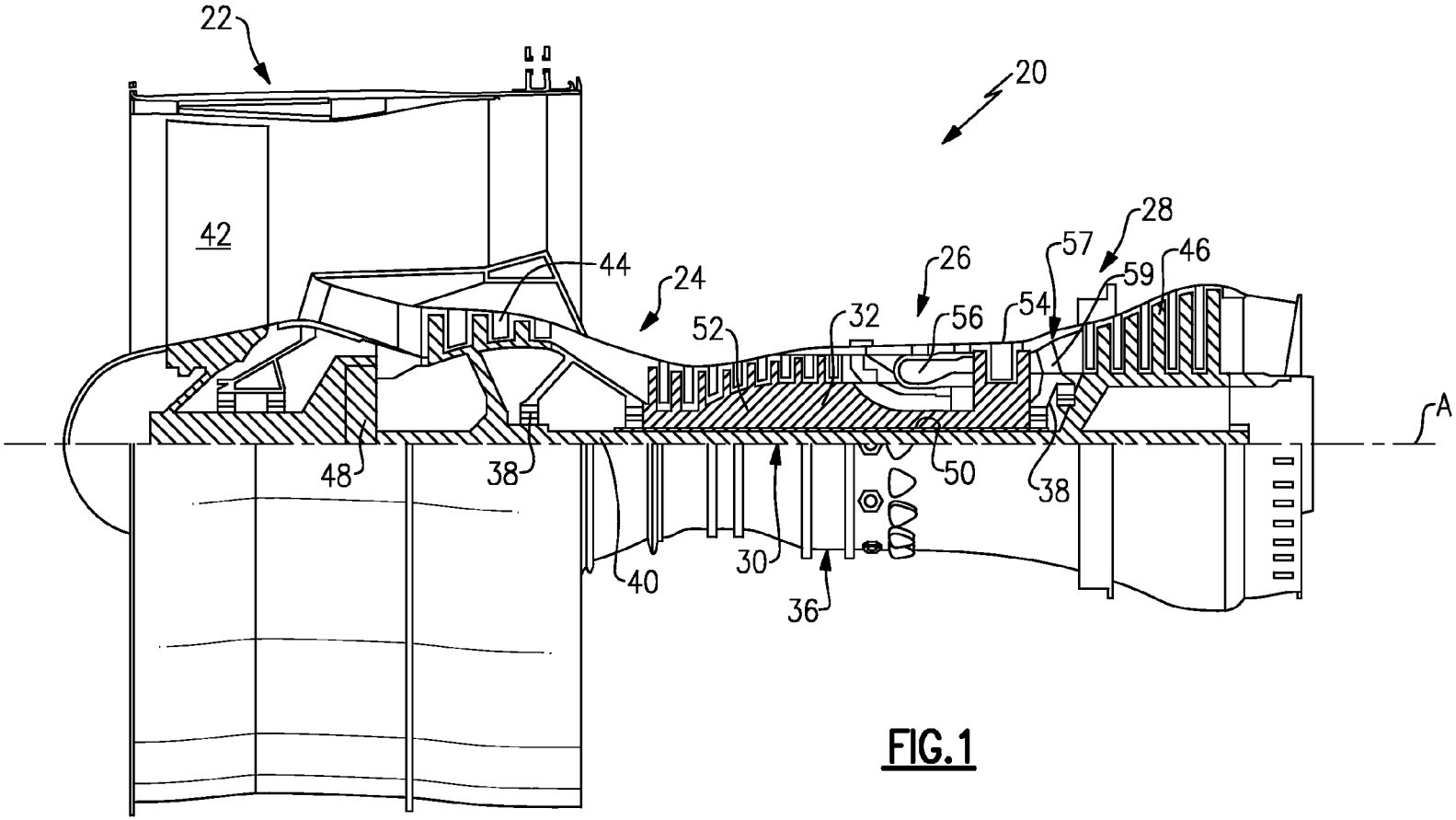
FIG. 1 is a schematic cross-section of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath while the compressor section 24 drives air along a core flowpath for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines including three-spool architectures.

The engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that interconnects a fan 42, a low pressure compressor 44 and a low pressure turbine 46. The inner shaft 40 is connected to the fan 42 through a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path. The turbines 54, 56 rotationally drive the respective low speed spool 30 and high speed spool 32 in response to the expansion.

Figure 2:
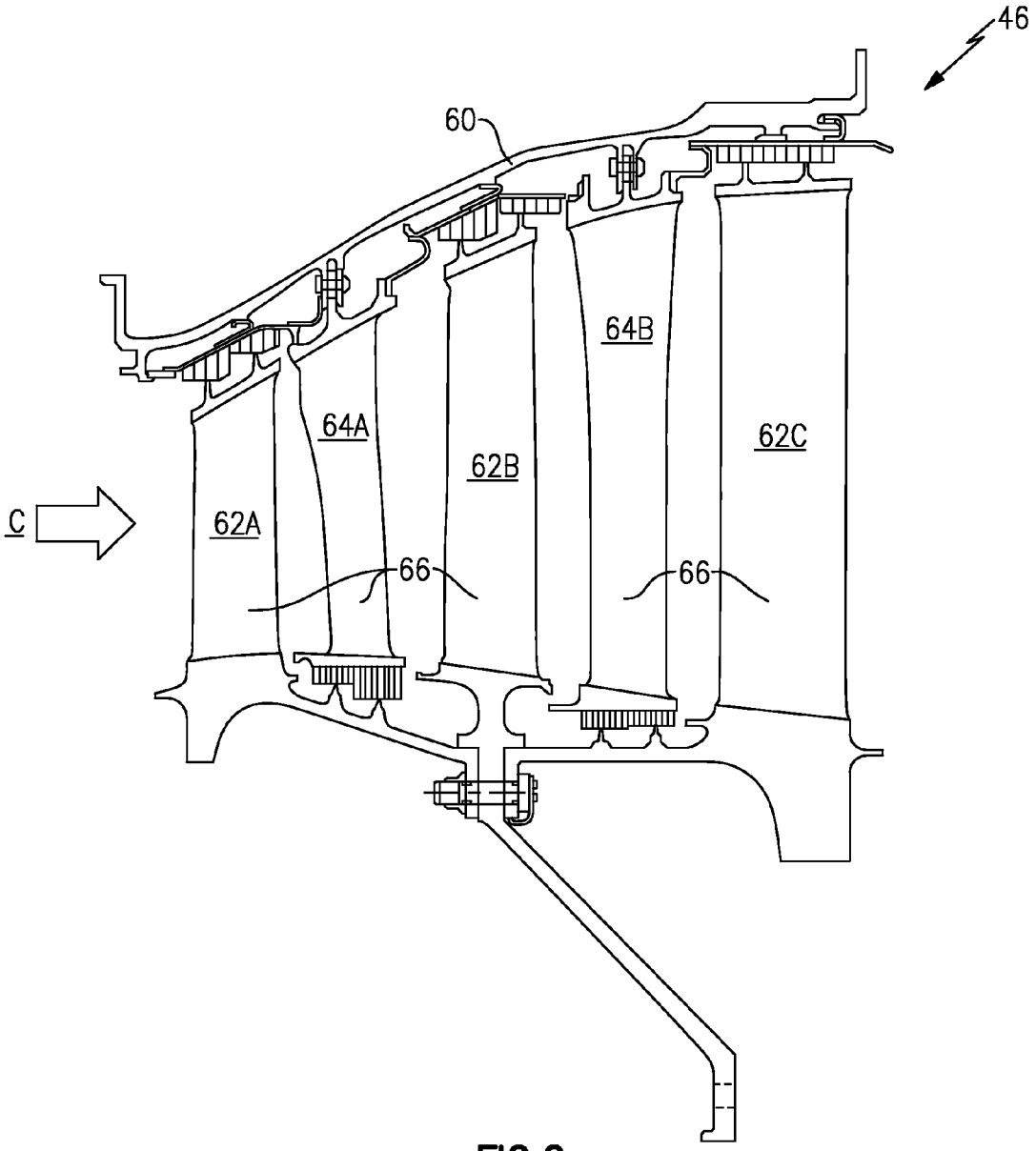
FIG. 2 is an enlarged sectional view of a Low Pressure Turbine section of the gas turbine engine.
Figure 3:
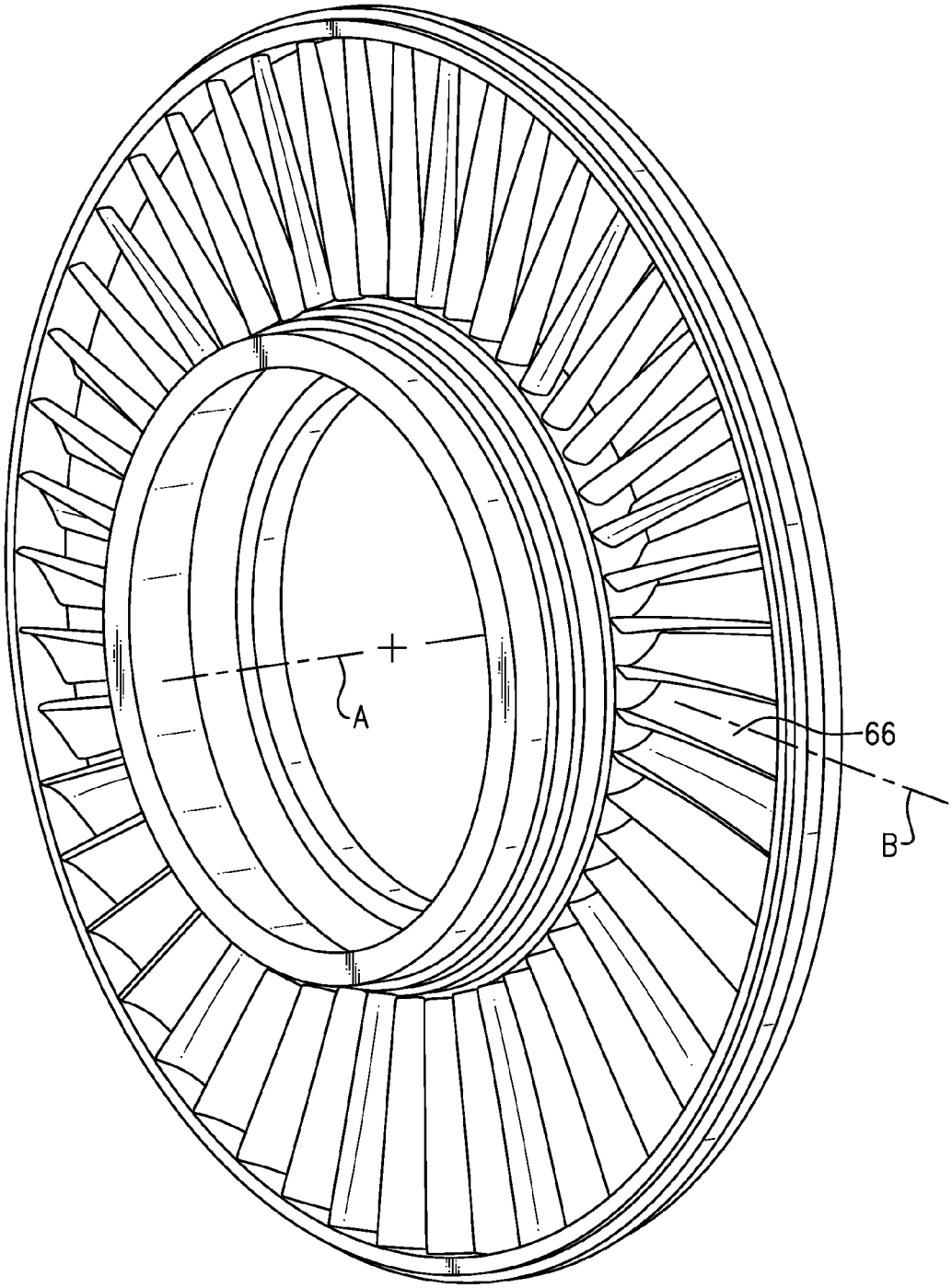
FIG. 3 is an enlarged perspective view of an example rotor disk of the Low Pressure Turbine section.
Figure 4:
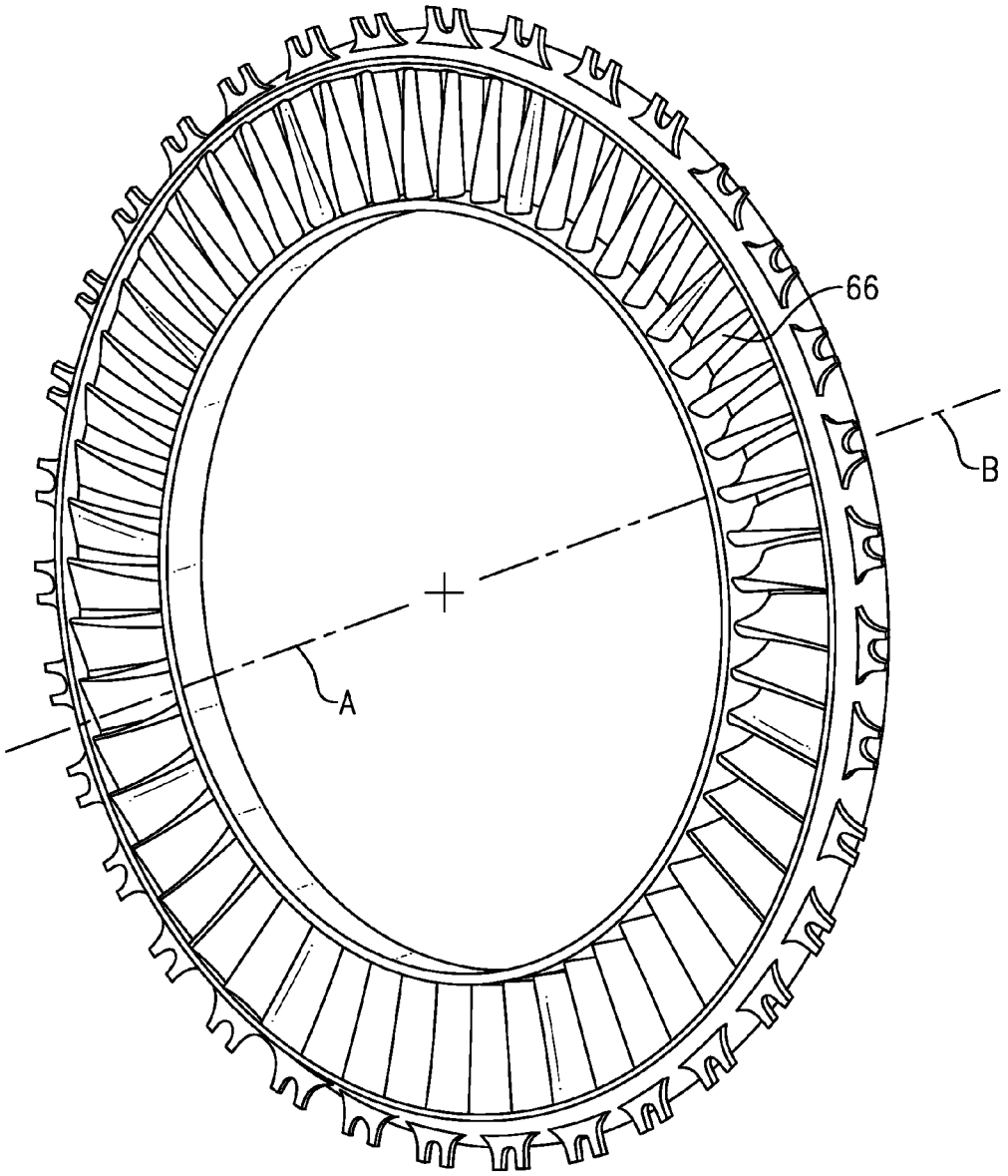
FIG. 4 is an enlarged perspective view of an example stator vane structure of the Low Pressure Turbine section.

With reference to FIG. 2, the low pressure turbine 46 generally includes a low pressure turbine case 60 with a multiple of low pressure turbine stages. The stages include a multiple of rotor structures 62A, 62B, 62C interspersed with vane structures 64A, 64B. Each of the rotor structures 62A, 62B, 62C and each of the vane structure 64A, 64B may include airfoils 66 manufactured of a ceramic matrix composite (CMC) material (FIGS. 3 and 4). It should be understood that examples of CMC material for componentry discussed herein may include, but are not limited to, for example, the CMC material S200 manufactured by COI Ceramic and a Silicon Carbide Fiber in a Silicon Carbide matrix (SiC/SiC). Although depicted as a low pressure turbine in the disclosed embodiment, it should also be understood that the concepts described herein are not limited to use with low pressure turbines as the teachings may be applied to other sections such as high pressure turbines, high pressure compressors, low pressure compressors, the mid turbine frame 57, as well as intermediate pressure turbines and intermediate pressure compressors of a three-spool architecture gas turbine engine.

Figure 5:
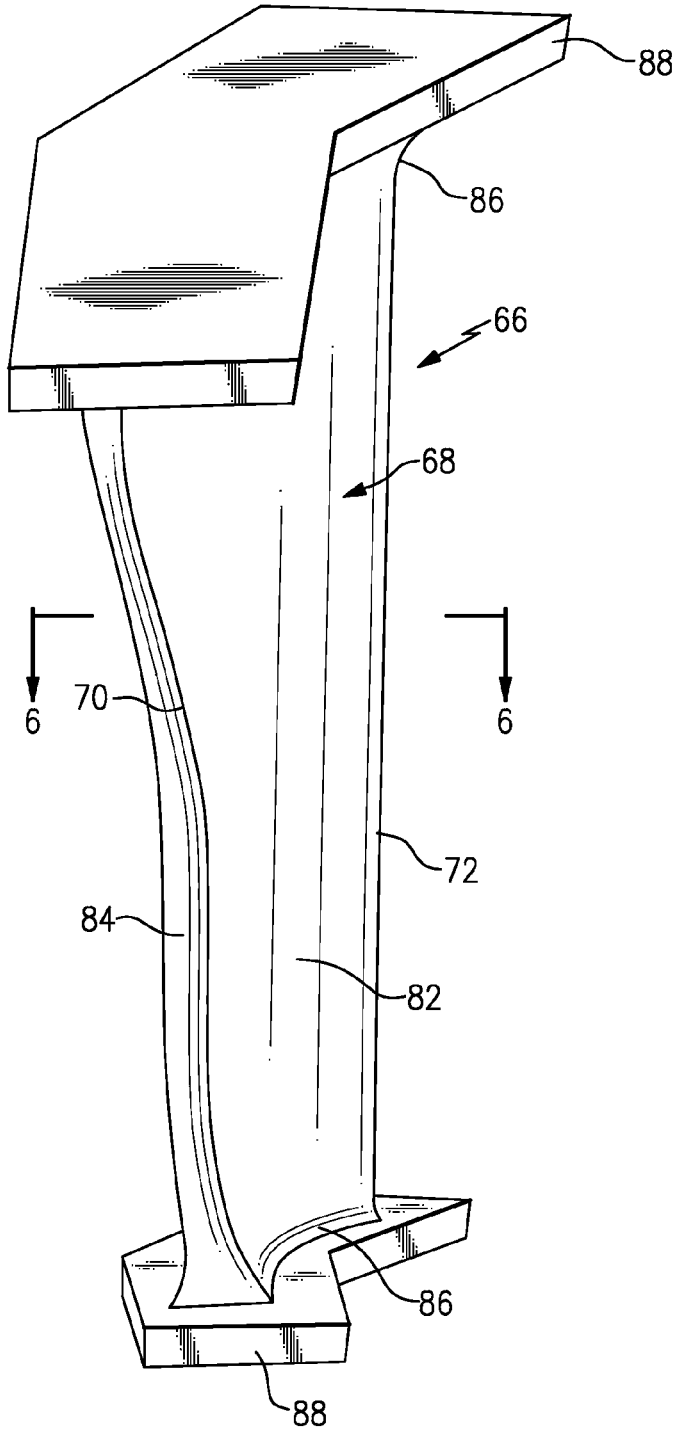
FIG. 5 is a perspective view of a CMC vane structure.

With reference to FIG. 5, one CMC airfoil 66 "singlet" is illustrated, however, it should be understood that other vane structures with, for example a ring-strut-ring full hoop structure will also benefit herefrom. Although a somewhat generic CMC airfoil 66 will be described in detail hereafter, it should be understood that various rotary airfoils or blades and static airfoils or vanes may be particularly amenable to the fabrication described herein.

The CMC airfoil 66 generally includes an airfoil portion 68 defined between a leading edge 70 and a trailing edge 72. It should be understood that the airfoil portion 68 may include various twist distributions. The airfoil portion 68 includes a generally concave shaped side which forms a pressure side 82 and a generally convex shaped side which forms a suction side 84. It should be further appreciated that various structures with a trailing edge will also benefit herefrom.

Each CMC airfoil 66 may include a fillet section 86 to provide a transition between the airfoil portion 68 and a platform segment 88. The platform segment 88 may include unidirectional plies which are aligned tows with or without weave, as well as additional or alternative fabric plies to obtain a thicker platform segment if so required. In the disclosed non-limiting embodiment, either or both of the platform segments segment 88 may be of a circumferential complementary geometry such as a chevron-shape to provide a complementary abutting edge engagement for each adjacent platform segment to define the inner and outer core gas path. That is, the CMC airfoils 66 are assembled in an adjacent complementary manner with the respectively adjacent platform segments 88 to form a cascade of airfoils.

Pressure distributions to which the CMC airfoil 66 is subjected is generally of a higher pressure and lower velocity along the pressure side 82 and a relatively lower pressure and higher velocity along the suction side 84. That is, there is a differential pressure across the chord of the CMC airfoil 66. This differential is also within the significant temperature environment of the turbine section 28 over which the core flow expands downstream of the combustor section 26.

Figure 6:
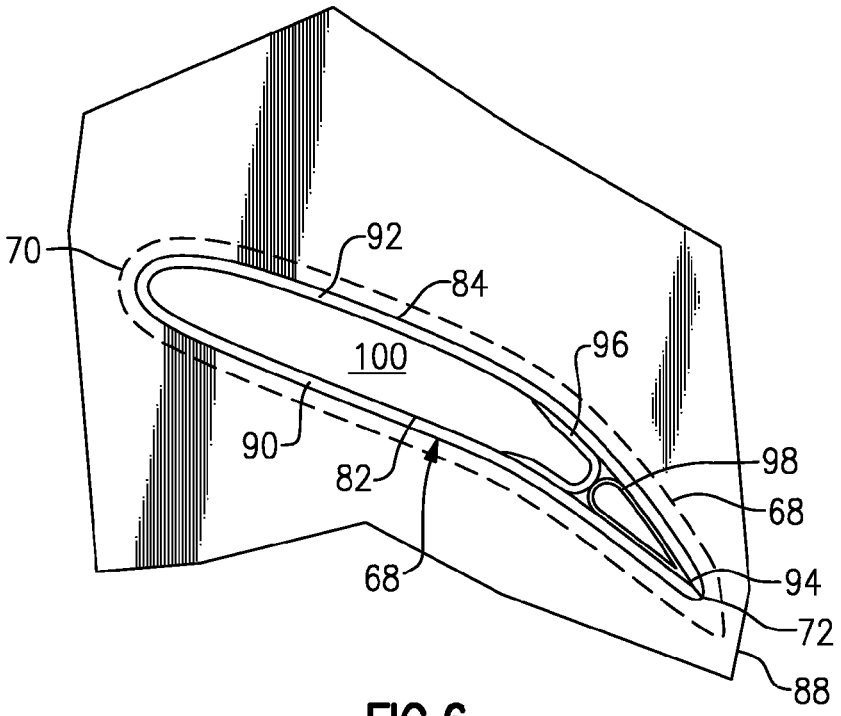
FIG. 6 is a sectional view of the stator vane structure of FIG. 5.
Figure 7:
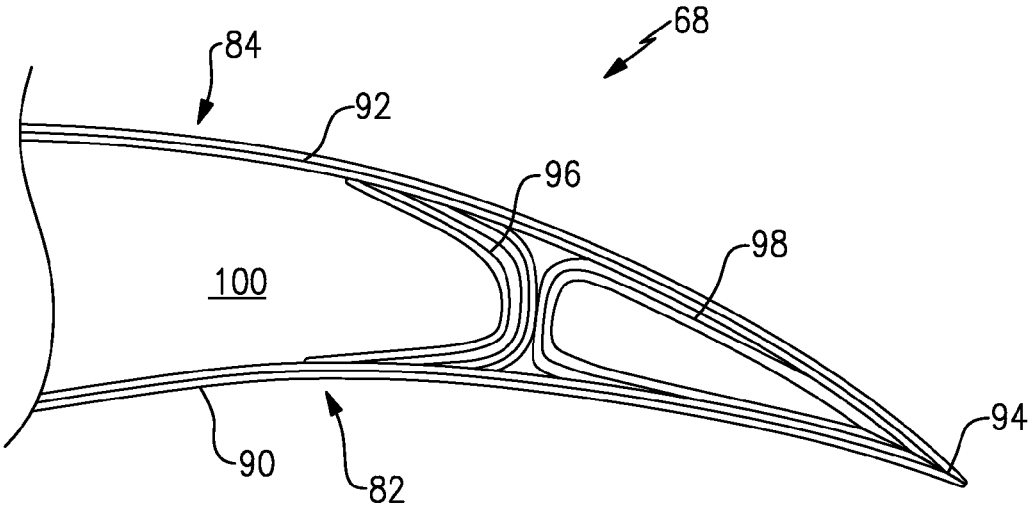
FIG. 7 is a sectional view of a trailing edge of the stator vane structure.

With reference to FIG. 6, the pressure side 82 and the suction side 84 may be formed from a respective first and second multiple of CMC plies 90, 92 which meet and may be bonded together along at the trailing edge 72 at an essentially line interface 94 (also shown in FIG. 7). Adjacent to the trailing edge 72 and within the CMC plies 90, 92 which define the airfoil portion 68 are located a forward trailing edge support 96 and an aft trailing edge support 98. As defined herein, "fore" to "aft" is in relation to the gas flow direction past the airfoil 66, such as the hot gas which flows past the turbine blade or vane in operation.

The forward trailing edge support 96 and the aft trailing edge support 98 in the disclosed, non-limiting embodiment are generally "C" shaped in which the open portion of the "C" of the forward trailing edge support 96 faces forward, while the open portion of the "C" of the aft trailing edge support 98 face aft to provide a back-to-back relationship. It should be appreciate that the "C" shape is a general description and that other shapes such as an "O"; "0"; "I" or other shape may also be utilized to provide significant surface area to bond with the CMC plies 90, 92. The forward trailing edge support 96 and the aft trailing edge support 98 may alternatively or additionally be formed as a monolithic ceramic material such as a silicon carbide, silicon nitride or alternatively from a multiple of CMC plies.

Figure 8:
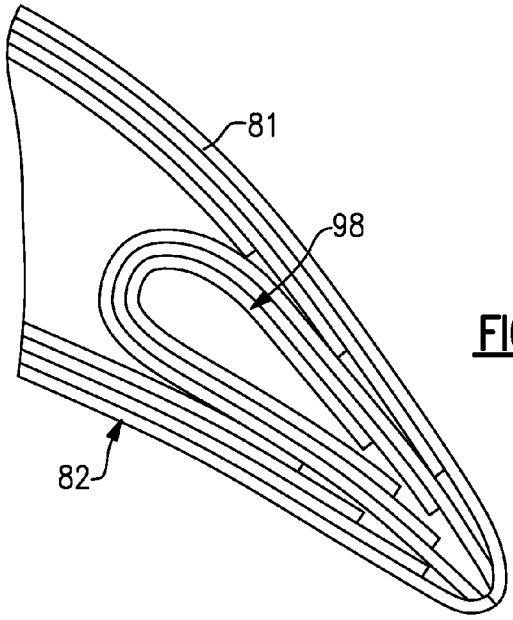
FIG. 8 is a sectional view of a trailing edge of another disclosed non-limiting embodiment of the stator vane structure.

The forward trailing edge support 96 defines an internal pressure vessel 100 within the CMC airfoil 66 between the CMC plies 90, 92 to receive, for example a cooling flow therethrough. In another non-limiting alternate embodiment, the forward trailing edge support 96 is not required as the aft trailing edge support 98' provides sufficient support for the expected internal pressure (FIG. 8).

The internal pressure vessel 100 strengthens the CMC airfoil 66 to resist the differential pressure generated between the core flow along the airfoil portion 68 and provides a passage for secondary cooling flow which may be communicated through the airfoil portion 68. It should be appreciated that other passages may be formed to provide a path for wire harnesses, conduits, or other systems.

For an uncooled or lightly cooled airfoil 66, a potential split S in the trailing edge 72 (FIG. 9) has no significant impact to the purpose of turning the flow. However, for hollow airfoils 66 that transport cooling air, the "C" section architecture prevents the loss of cooling air, because even a trailing edge 72 which has split is isolated from the main body cooling flow within the internal pressure vessel 100. That is, as the forward trailing edge support 96 faces forward and is bonded to the CMC plies 90, 92, the forward trailing edge support 96 facilitates formation of the pressure vessel 100 for the cooling air as the forward trailing edge support 96 may be pressed outward into the CMC plies 90, 92. This is a relatively stronger architecture than the pressure applied to the back side of the aft trailing edge support 98 in which the pressure may tend toward peeling the aft trailing edge support 98 from the CMC plies 90, 92.

The aft trailing edge support 98 may be arranged such that the open ends of the "C" touch each other. The aft trailing edge support 98 facilitates usage of a relatively small number of CMC plies 90, 92 at the trailing edge 72, such as 1-4 plies each, to form a sharp trailing edge 72.

Figure 9:
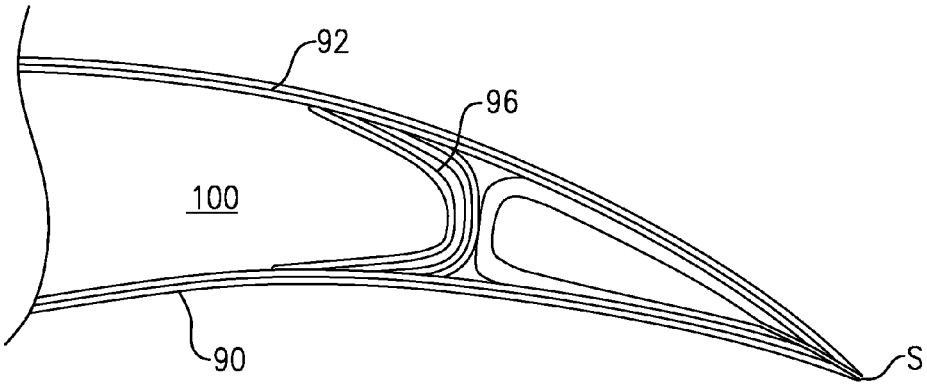
FIG. 9 is a sectional view of the trailing edge of another disclosed non-limiting embodiment of the stator vane structure illustrating a split trailing edge.

The aft trailing edge support 98 provides a desired bending strength through the appropriate consideration of section thickness and permits the trailing edge 72 to actually split, thus relieving stresses which may naturally occur (FIG. 9). The aft trailing edge support 98 prevents the split in the trailing edge 72 from debonding the CMC plies 90, 92. That is, the relatively higher pressure and lower velocity along the pressure side 82 and the relatively lower pressure and higher velocity along the suction side 84 actually forces the split in the trailing edge 72 together as the aft trailing edge support 96 compartmentalizes the external pressure from the internal pressure forward thereof. The trailing edge 72, once spilt is equalized in pressure and the CMC plies 90 on the pressure side 82, are pushed onto the aft trailing edge support 98. Thus, the presence of the aft trailing edge support 98 allows the force on the pressure side 82 to be resisted, and the split sees a compressive load.

Figure 10:
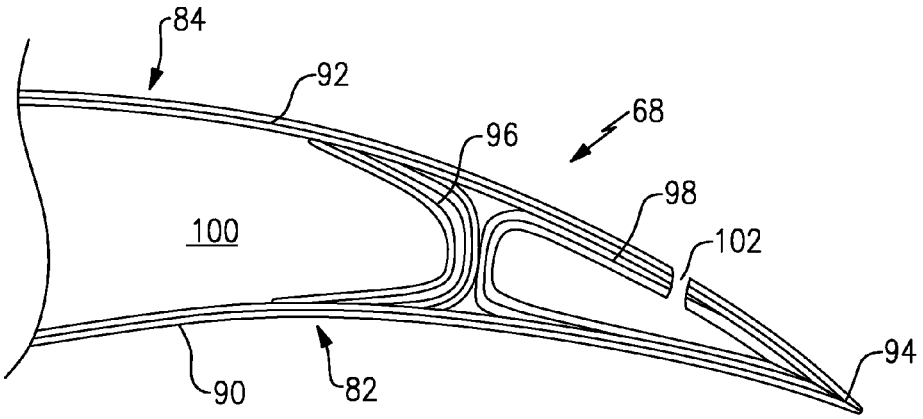
FIG. 10 is a sectional view of a trailing edge of another disclosed non-limiting embodiment of the stator vane structure illustrating a vent.

In another disclosed non-limiting embodiment, a vent 102 is located through the suction side 84 to selectively balance the internal pressure within the aft trailing edge support 98 with the low external core path pressure on the suction side, which further tends to minimize the internal pressurization, and the initial potential for a split in the trailing edge 72 (FIG. 10).

Figure 11:
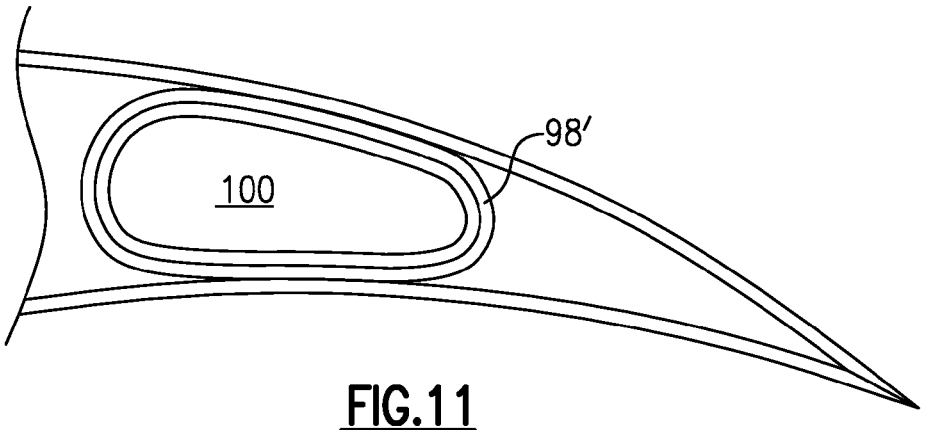
FIG. 11 is a sectional view of a trailing edge of another disclosed non-limiting embodiment of the stator vane structure.
Figure 12:
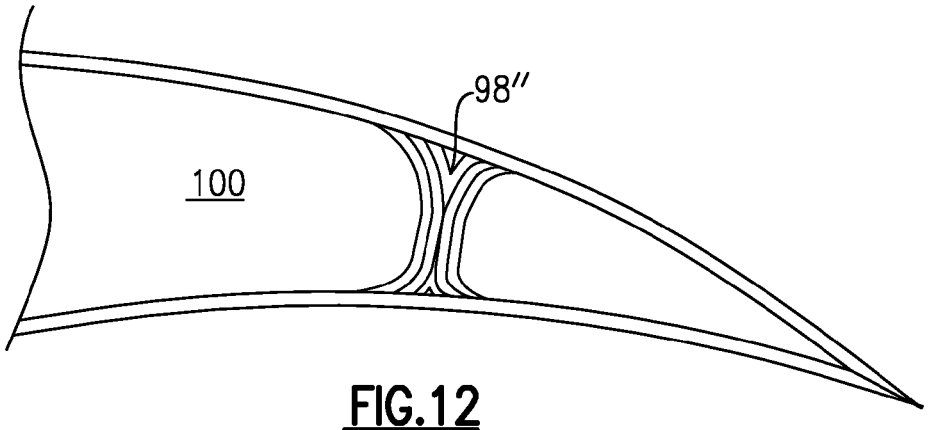
FIG. 12 is a sectional view of a trailing edge of another disclosed non-limiting embodiment of the stator vane structure.

In another disclosed non-limiting embodiment, other shapes such as an "O"; "0" (FIG. 11) aft trailing edge support 98'; "I" aft trailing edge support 98" (FIG. 12) or other shape may also be utilized to provide significant surface area to bond with the CMC plies 90, 92.

It should be understood that like reference numerals identify corresponding or similar elements throughout the several drawings. It should also be understood that although a particular component arrangement is disclosed in the illustrated embodiment, other arrangements will benefit herefrom.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. An airfoil for a gas turbine engine comprising:

a pressure side formed of at least one Ceramic Matrix Composite ply;

a suction side formed of at least one Ceramic Matrix Composite ply; and an aft trailing edge support between said pressure side and said suction side, wherein an open portion of said aft trailing edge support is open toward a trailing edge where said pressure side meets said suction side.

2. The airfoil as recited in claim 1, wherein said aft trailing edge support is "C" shaped.

3. The airfoil as recited in claim 1, further comprising a vent through said suction side.

4. The airfoil as recited in claim 1, further comprising a forward trailing edge support between said pressure side and said suction side.

5. The airfoil as recited in claim 4, wherein said forward trailing edge support formed of at least one Ceramic Matrix Composite ply.

6. The airfoil as recited in claim 4, wherein said forward trailing edge support is back to back with said aft trailing edge support.

7. The airfoil as recited in claim 4, wherein said aft trailing edge support is "C" shaped.

8. The airfoil as recited in claim 7, wherein an open portion of said forward trailing edge support is open away from a trailing edge where said pressure side meets said suction side.

9. The airfoil as recited in claim 4, wherein said aft trailing edge support is "O" shaped.

10. The airfoil as recited in claim 1, wherein said aft trailing edge support is manufactured of a CMC composite.

11. The airfoil as recited in claim 1, wherein said airfoil is within a turbine section of a gas turbine engine.

12. The airfoil as recited in claim 11, wherein said gas turbine engine includes a geared architecture.

13. The airfoil as recited in claim 1, wherein said airfoil is within a mid-turbine frame of a gas turbine engine.

14. An airfoil for a gas turbine engine comprising:

a pressure side formed of at least one Ceramic Matrix Composite ply;

a suction side formed of at least one Ceramic Matrix Composite ply;

a forward trailing edge support between said pressure side and said suction side; and an aft trailing edge support between said pressure side and said suction side, wherein said aft trailing edge support is "I" shaped.

15. An airfoil for a gas turbine engine comprising:

a pressure side formed of at least one Ceramic Matrix Composite ply;

a suction side formed of at least one Ceramic Matrix Composite ply;

an aft trailing edge support between said pressure side and said suction side; and a forward trailing edge support between said pressure side and said suction side, wherein each of said forward trailing edge support and said aft trailing edge support are "C" shaped, and said forward trailing edge support is back to back with said aft trailing edge support.

16. The airfoil as recited in claim 15, wherein an open portion of said forward trailing edge support is open away from a trailing edge where said pressure side meets said suction side.

17. The airfoil as recited in claim 16, wherein an open portion of said aft trailing edge support is open toward said trailing edge where said pressure side meets said suction side.

18. The airfoil as recited in claim 15, wherein said aft trailing edge support and said forward trailing edge support are formed of a Ceramic Matrix Composite.

19. A method of assembling a Ceramic Matrix Composite airfoil for a gas turbine engine comprising:

venting an airfoil aft of an aft trailing edge support between a pressure side and a suction side, wherein an open portion of said aft trailing edge support is open toward a trailing edge where the pressure side meets the suction side.

20. The method as recited in claim 19, wherein the venting occurs through a vent formed through the suction side.

21. The method as recited in claim 19, wherein the venting occurs through a split between the pressure side and the suction side.

* * * * *